United States Patent [19]

Gillbrand et al.

[11] Patent Number: 4,947,810

[45] Date of Patent: Aug. 14, 1990

[54] METHOD AND ARRANGEMENT FOR IMPROVING THE STARTING ABILITY OF AN INTERNAL COMBUSTION ENGINE, WHEN AN ATTEMPT TO START THE ENGINE HAS FAILED

[75] Inventors: Per Gillbrand, Mariefred; Hans Johansson; Jan Nytomt, both of Åmål, all of Sweden

[73] Assignee: Saab-Scania Aktiebolag, Sweden

[21] Appl. No.: 236,663

[22] Filed: Aug. 25, 1988

[30] Foreign Application Priority Data

Aug. 28, 1987 [SE] Sweden ..... 8703329

[51] Int. Cl.[5] ..... F02P 9/00

[52] U.S. Cl. ..... 123/179 BG; 123/169 CL; 123/198 A; 123/625; 123/637

[58] Field of Search ..... 123/179 BG, 198 A, 606, 123/625, 636, 637, 639, 607, 608, 169 CL

[56] References Cited

U.S. PATENT DOCUMENTS

| | | | |
|---|---|---|---|
| 2,450,524 | 10/1948 | Root | 123/179 BG |
| 2,843,645 | 7/1958 | Sigworth et al. | 123/198 A |
| 3,170,451 | 2/1965 | Fortier | 123/179 BG |
| 3,280,809 | 10/1966 | Issler | 123/637 |
| 3,589,348 | 6/1971 | Reichhelm | 123/169 PB |
| 4,024,469 | 5/1977 | Bobulski | 324/16 R |
| 4,341,195 | 7/1982 | Nishio et al. | 123/598 |
| 4,442,821 | 4/1984 | Hamai et al. | 123/639 |
| 4,517,943 | 5/1985 | Bert et al. | 123/198 A |

FOREIGN PATENT DOCUMENTS

| | | | |
|---|---|---|---|
| 0142478 | 5/1985 | European Pat. Off. . | |
| 0147678 | 7/1985 | European Pat. Off. . | |
| 2645226 | 4/1978 | Fed. Rep. of Germany . | |
| 55-112870 | 9/1980 | Japan | 123/169 CL |
| 59-192866 | 11/1984 | Japan . | |

*Primary Examiner*—Andrew M. Dolinar

*Attorney, Agent, or Firm*—Ostrolenk, Faber, Gerb & Soffen

[57] ABSTRACT

The invention relates to a method and arrangement for cleaning the spark plugs of an internal combustion engine automatically subsequent to the engine stopping and then, preferably, after an unsuccessful attempt to start the engine. Consequently, conditions for a successful starting attempt are made more favorable. Conditions preventing the start of an engine are often due to the presence of deposits on one of the spark plugs, these deposits preventing an ignition spark from being produced in the cylinder. The inventive method and arrangement solve this problem by burning clean the spark plugs immediately after the engine has stopped, and then preferably after the engine has failed to start. A detection means establishes whether or not the engine has started by sensing a suitable engine parameter, preferably engine speed, through a speed indicator. When the detection means detects that the engine has stopped or has failed to start, a signal is sent to the control unit, which subsequently causes the ignition system to generate a shower of sparks in close succession on all spark plugs, either in parallel or in one cylinder at a time. The spark showers burn-off any deposits on the spark-plugs.

8 Claims, 3 Drawing Sheets

METHOD AND ARRANGEMENT FOR IMPROVING THE STARTING ABILITY OF AN INTERNAL COMBUSTION ENGINE, WHEN AN ATTEMPT TO START THE ENGINE HAS FAILED

FIELD OF THE INVENTION

This invention relates to a method and arrangement for improving the starting ability of an internal combustion engine equipped with spark ignition, preferably after an unsuccessful earlier attempt to start the engine.

BACKGROUND OF THE INVENTION

In one earlier known method for maintaining spark plugs free from deposits, sparks are generated repeatedly between the spark plug electrodes.

The U.S. Pat. No. 4,341,195 teaches an ignition system in which under certain engine conditions, and when running of the engine has become established, a spark discharge is generated continuously across the plug with the aid of a specific ignition circuit. The number of discharges generated is inversely proportional to the speed of the engine and proportional to the engine load.

The U.S. Pat. No. 4,024,469 teaches an arrangement in which the plug gap is measured by means of a measuring system which is connected to an ignition system and which applies a high alternating voltage across the plug, so as to burn off deposits formed thereon.

The German Patent Specification 26,45,226 describes an ignition system with which a thin-walled precombustion chamber is heated by repeatedly effecting an electrical discharge across the spark plugs.

For the purpose of facilitating an engine start in cold and moist conditions arrangements have also been proposed for heating the actual spark plugs with the aid of a direct current; see, for instance, U.S. Pat. No. 3,589,348.

The foregoing prior art, however, has presented complicated solutions which require the provision of numerable ancillary devices and components additional to the conventional ignition system. In some cases the ignition system has been incapable of burning off carbon deposits effectively, particularly when engine starting conditions are difficult. Neither have the systems automatically come into function after the engine has stopped, especially after having tried unsuccessfully to restart the engine.

SUMMARY AND OBJECTS OF THE INVENTION

An object of the present invention is to control an ignition system after an unsuccessful attempt to start an engine, with the engine dead or substantially dead in a manner to produce a plurality of sparks on all spark plugs despite the fact that the engine is practically dead. The shower of sparks generated across the plugs will burn off any deposits that may be present, so that the plugs will be in good condition for the next engine starting attempt. To this end the inventive method comprises the steps of (a) detecting when the engine ceases to rotate or has substantially come to a standstill after having been rotating; (b) generating a state-of-engine signal corresponding to such state of the engine; and (c) responsive to such state-of-engine signal, producing a close succession of sparks across spark plugs of the engine. This results in the burning-off of any deposits on the spark plugs.

The inventive method ensures that the spark plugs are cleaned automatically when the engine stops, while a preferred method ensures that the plugs are cleaned when activation of the starting motor has ceased and the engine has not started.

The inventive method therefore improves the chances of success when a new attempt is made to start the engine. The failure of an engine to start is very likely due to the build-up of deposits on the start plugs. The deposits are effectively burned away by the shower of sparks produced across the spark plugs, in accordance with the inventive method.

In the case of a preferred embodiment of the invention, the driver himself can decide whether or not a spark shower shall be generated. The sparks in this instance are generated by holding the ignition key in an ignition position, subsequent to turning the key from an engine start position. On the other hand, no spark shower will be generated when the ignition key is turned to a closed or off position immediately after the engine start position.

The spark shower can be generated in parallel over all of the plugs simultaneously. However, when the ignition system comprises only one charge accumulator, preferably a capacitor, the spark shower can be generated across the ignition devices in each cylinder per se, so that each spark will have the maximum discharge effect or power.

It is necessary that the sparks in the spark shower are generated in close succession, such that the energy generated in the spark shower will cause deposits located around the spark-plug electrodes to be burned off. The sparks should therefore have a frequency of at least 200 Hz.

There is no upper limit to the number of sparks forming the spark shower, and in some cases each spark shower may comprise several thousand sparks. With regard to the lower limit, however, each spark shower should contain at least from five to six sparks for each spark plug in engine ignition systems having an ignition voltage of about 40,000 volts under normal conditions.

The invention also relates to an arrangement for carrying out the inventive method.

The arrangement includes an ignition system of the type including ignition devices in each cylinder of an internal combustion engine. Such ignition system corresponds essentially to an ignition system of the kind previously described in our Swedish Patent Specification 437,386, corresponding to U.S. Pat. No. 4,637,368.

The arrangement includes an electronic control unit which is capable of initiating a spark discharge on the ignition devices in response to at least one sensor intended for sensing an engine parameter. The ignition system further includes a detecting means connected to the sensor and to the control means and operative to detect whether the engine has started or not when an attempt to start the engine is made. The control unit is constructed to initiate the generation of a close succession of spark discharges in the ignition devices when the detection means indicates that the engine has not started.

The detecting means, which is characteristic of the invention and which is operative in detecting engine operation, preferably engine speed, sends a signal to the ignition system in the absence of such engine operation or when such operation decreases or tails off when an attempt is made to start the engine. The detecting means may comprise a separate logic circuit, although in the case of an ignition system of the kind mentioned in the above-cited SE 437,286, the detecting means will advantageously comprise a comparison module which is programmed into a microcomputer-based control unit. Such programming obviates the need for the provision of additional components, when the engine speed, which constitutes the fundamental detection parameter, is sensed by the control unit through an existing engine speed indicator.

Other characteristic features of the invention are disclosed in the following claims and are also made apparent in the following description of an exemplifying embodiment of the invention.

BRIEF DESCRIPTION OF THE DRAWINGS

The description is made with reference to the accompanying drawings, in which.

DETAILED DESCRIPTION OF THE PREFERRED EMBODIMENTS

Figure 1:
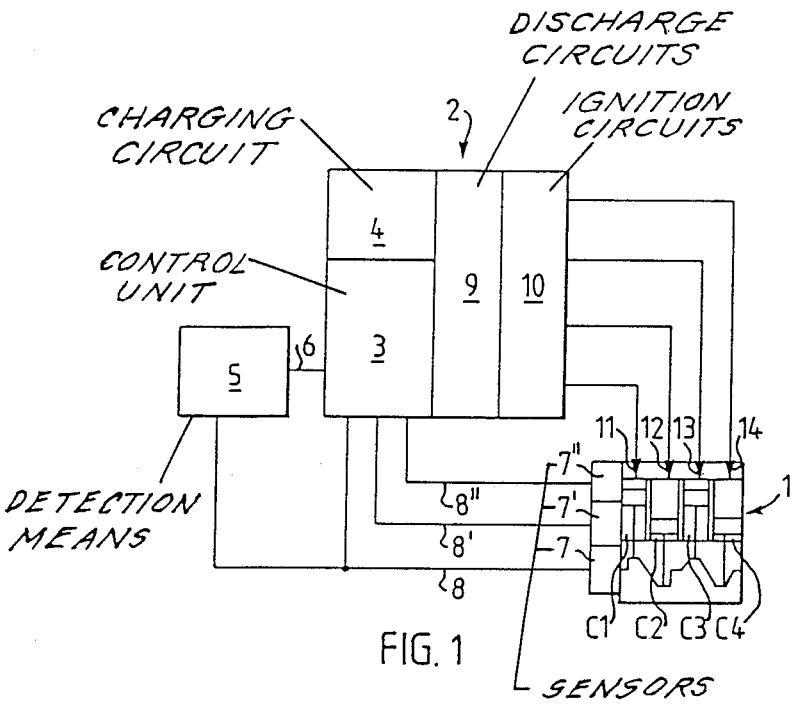
FIG. 1 is a block schematic which illustrates an inventive arrangement used in conjunction with an internal compustion engine.

FIG. 1 illustrates the manner in which a signal is passed from a crankshaft sensor 7 located on an Otto-cycle engine 1 through a line 8 to an ignition system 2 which is controlled by a microcomputer and which in turn controls the engine ignition. The system includes a control unit 3 in which a microcomputer calculates the ignition timing for respective engine cylinders, this calculation being effected on the basis of data arriving on respective data lines 8, 8' and 8" from the crankshaft sensor 7, an engine temperature sensor 7', an inlet pressure sensor 7" and optional additional sensors or transducers. The ignition system 2 further includes a detection circuit 5 which is connected to the data line 8 and is effective for detecting the absence of engine operation or, subsequent to an attempt to start the engine resulting in at least some engine operation or some engine speed, in detecting that engine operation has stopped or that engine speed has tailed off. The detection circuit 5 will then send a signal to the control unit 3, on the line 6. The ignition system 2 is a capacitive-type system and further includes a charging circuit 4, discharge circuits 9, and ignition circuits 10 for the spark plugs 11–14 or respective cylinders C1, C2, C3, C4 of the Otto-cycle engine.

Figure 2:
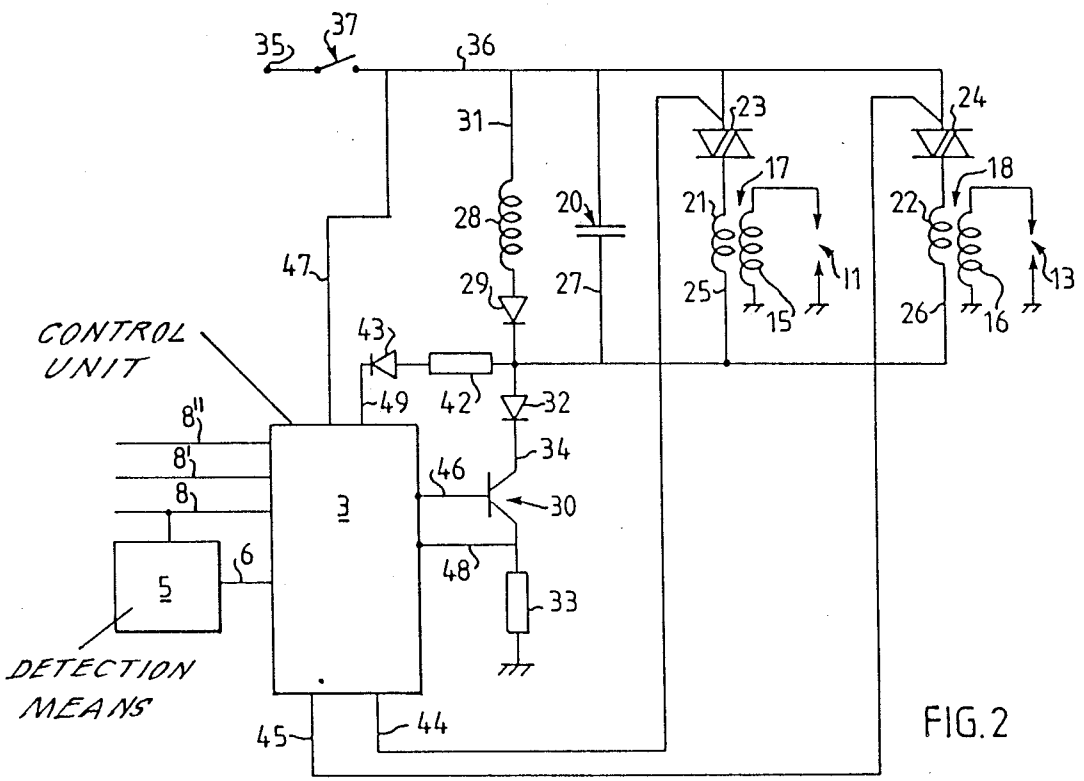
FIG. 2 is a circuit diagram of the engine ignition system.

FIG. 2 is a circuit diagram of one embodiment of an ignition system according to the invention. Of the spark plugs 11–14 shown in FIG. 1, only the plugs 11 and 13 are shown in FIG. 2, and then only schematically, each of said plugs being connected to a secondary winding 15–16 of a corresponding number of ignition coils 17, 18. Each of the primary windings of the ignition coils 17, 18 is connected in series with a respective electric switch 23, 24, which in the illustrated case have the form of triacs. Each primary winding 21, 22 and triac 23, 24 form a discharge circuit 25, 26 which is connected in parallel to an ignition capacitor 20 incorporated in a line 27.

The capacitor 20 is charged by means of a charging circuit which is connected in parallel with the capacitor 20 and which comprises a coil 28, hereinafter called choke, which is connected in series with a diode 29 incorporated in a line 31. The line 27 incorporating the capacitor 20, together with all lines 25, 26, 31 connected in parallel therewith, is connected on one side to a second switch 30, e.g. a transistor, which is connected in series with a second diode 32 and a resistor 33 in a line 34, and the other side to a d.c. source 35, preferably a 12 V battery, via a line 36 which incorporates an ignition key switch 37. The diodes 29, 32 are poled so that when the transistor 30 is open to conduct current, current can be supplied from the battery 35 to earth through the lines 31, 34.

The triacs 23, 24 in the discharge circuits and the transistor 30 in the charging circuit are steered by signals sent from the control unit 3 on respective lines 44, 45 and 46. In addition to the signals fed into the control unit 3 on the lines 8—8", shown in FIG. 1, the control unit is also supplied with a signal on line 47 indicative of the voltage level of the battery 35. A line 48 connects the control unit 3 with the line 34 extending between the transistor 30 and the resistor 33 and applies to the control unit 3 a potential which corresponds to the charging current. The control unit 3 is also provided with data concerning the potential of the ignition capacitor 20, via a line 49 which incorporates a resistor 42 and a diode 43.

As previously mentioned, the detection circuit 5 detects engine movement on the data line 8 and, when detecting an unsuccessful attempt to start the engine, sends a signal to the control unit 3 on the line 6.

In principle, the arrangement illustrated in FIG. 2 operates in the following manner.

When starting the engine, the driver manually closes the switch 37 in the line 36, by turning the ignition key from an off position. The switch 37 is closed both in an ignition position and in an engine starting position. When the key is turned to the engine start position, a starting motor (not shown) is activated in a conventional manner, so as to turn over the engine 1. When the switch 37 is closed, voltage is applied via the line 36 and the battery 35 to the ignition system circuit 31, 34 with the choke 28, the diodes 29, 32, the transistor 30 and the resistor 33 connected to earth. When starting the engine, the control unit 3 holds the triacs 23, 24 closed, whereas the transistor 30 is held open so that current can pass therethrough. When the charging current, and the corresponding potential on the line 48, has reached a predetermined value, the control unit 3 interrupts the passage of current through the transistor 30. Energy stored in the choke 28 is thereby transferred to the capacitor 20, which is therewith charged. When the control unit 3 sends an output signal to, e.g., the triac 23 in response to the input signals on the lines 8—8", the triac 23 is opened at the ignition time point determined in the control unit 3 and on the basis of the input signals and the ignition capacitor 20 is dischargd through the primary winding 21. In this way there is generated in the secondary winding 15 an ignition voltage which produces an ignition spark on the spark plug 11 at the determined ignition time.

The potential of the ignition capacitor 20 is detected by the control unit 3 via the line 49 and when the detected value is found to lie beneath a predetermined value, the control unit 3 will initiate a new charging cycle, by sending an output signal on the line 46 to the transistor 30, causing the transistor to open. The triac 23, at the same time, has reclosed the line 25, preventing current from passing therethrough. Consequently, recharging of the ignition capacitor 20 will commence upon termination of the discharge process, so as to recharge the capacitor 20 quickly for the next ignition process in line. In the case of an 11 V battery voltage, the capacitor charging time is up to 6 ms, whereas in the case of a 5 V battery voltage charging of the capacitor will take up to 12 ms, or at least less than 15 ms.

Figure 3:
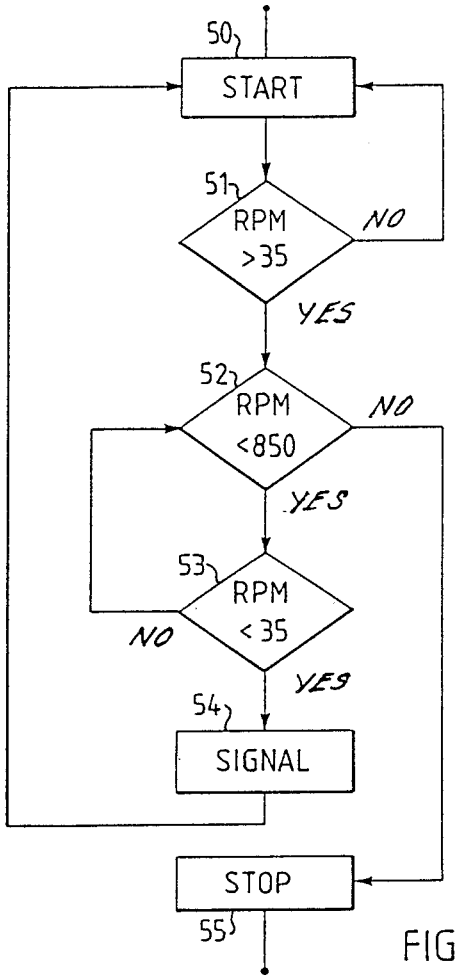
FIG. 3 is a flow sheet which illustrates detection of an aborted engine starting sequence.

Should the detection circuit 5 detect that the engine 1 has stopped or has practically stopped, a signal is sent to the control unit 3, on the line 6. In the case of a preferred embodiment, this detection of operation of the engine 1 is carried out in accordance with a detection program illustrated in the flow sheet of FIG. 3. Turning to that figure, detection process is commenced in an engine start stage 50 immediately upon application of voltage to the ignition system. The time or duration between two pulses transmitted on the line 8 extending from the crankshaft sensor 7 is therewith utilized in detecting the speed of the engine 1.

The prevailing engine speed is compared with a given lowest engine speed in a subsequent operation stage 51, in order to ascertain whether or not the prevailing speed is higher than the given lowest speed, which in the case of the illustrated embodiment is 35 rpm. This lowest speed is set at a value which is sufficiently low to ensure that engine starting speeds at low temperatures will not fall beneath such lowest speed. When the speed detected in the operation stage 51 is not higher than 35 rpm, a starting attempt has not been initiated and the program then return to the start stage 50.

A starting attempt is detected by exceeding the set lowest speed of 35 rpm, whereupon the program steps to an operation stage 52. In this stage a comparison is made in order to ascertain whether the speed lies above a predetermined value, so as to establish whether or not the engine is running smoothly and in a stable fashion and whether or not the starting sequence has been left. The predetermined engine speed applied in the operation stage 52 is preferably twice the normal starting speed, e.g. a speed of 850 rpm.

If the prevailing engine speed is not higher than 850 rpm, the program steps forward to an operation stage 53, in which a comparison is made in order to establish whether or not the engine has stopped or has nearly stopped. In this case, the prevailing engine speed is compared suitably with the same speed value as that which in the operation stage 51 indicated that an attempt to start the engine had been made, e.g. a speed of 35 rpm. If the prevailing speed is not slower than 35 rpm, the program will step back to the operation stage 52.

Consequently, the program will move between the operation stages 52 and 53 until the engine has either stopped or runs smoothly.

When the operation stage 52 detects that the engine is running smoothly, the program will step immediately to an operation stage 55, where the program rests as long as there is a voltage applied to the ignition system.

On the other hand, if the operation stage 52 detects that the engine has stopped, the program steps to an operation stage 54, where a signal is produced on the line 6 (FIG. 2). The program then steps to the operation stage 50, to again be able to ascertain whether or not a subsequent starting attempt will fail. In this way no signal is produced on the line 6 if a first activation of the ignition key to the ignition position takes place or if the engine has been running smoothly.

Thus, the control unit 3 receives on the line 6 a signal which indicates that an attempt to start the engine has been unsuccessful and that the engine is practically dead. Immediately after it has detected such signal, the control unit 3 will initiate a spark cleaning-process in which deposits are burned away from all plugs, provided that the ignition key is held in the ignition position immediately after leaving the starting position and that voltage is still applied to the ignition system.

The deposits are thus burned off the spark plugs 11–14 with the engine stopped and with a voltage applied to the ignition system, as a result of a close succession of control signals sent by the control unit 3 on the line 46 to the charging circuit and on the lines 44 and/or 45 to the discharge circuits.

This burning-off of the deposits can be effected in parallel on all spark plugs 11, 13, by discharging all of the energy stored in the ignition capacitor 20 across all of the spark plugs 11–14 at the same time, by sending control signals simultaneously to the triacs 23, 24.

In order to obtain the maximum effect from each spark, the control unit 3 may be constructed so that burning-off of the deposits is effected cylinderwise. The energy stored in the discharge circuit 9 is therewith released across one spark plug 11 several times, so as to produce a shower of sparks across said spark plug before moving on to the next spark plug 13 in order to remove the deposits thereon in a corresponding manner.

By controlling the transmission of control signals from the control unit 3 to the triacs 23, 24 in accordance with a given time sequence, in which a time lapse of 12–15 ms takes place between the first control signal and the next control signal, the ignition capacitor 20 will be charged to a maximum, down to a battery voltage of 5 volts.

The control unit 3 can also detect the potential of the ignition capacitor 20 via the line 49, and when the detected potential is sufficient sends the next control signal to the triacs 23, 24.

Due to the rapid build-up of an electric charge in the ignition capacitor 20 and to the rapid discharge process, and also to the ability of the capacitive ignition system to produce ignition sparks of up to 40,000 volts, any deposits located on and adjacent the spark-plug electrodes will be burned off effectively when the sparks are applied in close succession, in the form of a spark shower, across the spark-plug subsequent to an aborted attempt to start the engine.

In the case of capacitive ignition systems which produce ignition sparks of up to 40,000 volts, depositing on the spark-plug electrodes and the spark-plug isolator are burned off effectively after applying 5 to 6 sparks on each electrode at a normal battery voltage.

However, in order to enure that such deposits are truly burned-off, the number of sparks produced may be made inversely proportional to the battery voltage, so as to achieve the effect desired. The number of sparks generated need not therefore be restricted to the above-mentioned number when the battery voltage is lower.

The above-described embodiment does not limit the scope of the invention, since several modifications can be made within the scope of the following claims. For example, the reference to an ignition capacitor and like devices is intended to include a multiple of ignition capacitors connected in parallel and functioning as one single capacitance. The comparison made in the detection program in the operation stage 52 may also be made on the basis of criteria other than speed, in order to establish whether or not the engine runs smoothly. In the case of ignition systems in which the firing order is not specifically determined when starting an engine and ignition takes place in all cylinders in which the piston is located adjacent to a top-dead-centre position, the operation stage 52 may be constructed to detect whether or not the firing order is a set order, and if such is the case the program can step to the operation stage 55. In the case of another variant, the operation stage 52 is constructed to ascertain whether the engine has continued to run for a given minimum period of time, preferably 20–30 seconds, whereafter the detection program steps immediately to the operation stage 55.

What is claimed is:

1. A method for improving the starting ability of an internal combustion engine of the type including a spark-plug equipped ignition system, the method comprising the steps of detecting at least one of the state of when an attempt to start the engine has failed and the state of the engine having come to a virtual standstill after having been rotating; generating a state-of-engine signal corresponding to at least one of the foregoing states of the engine; and responsive to said state-of-engine signal producing a close succession of sparks across spark plugs of the engine, so as to burn-off any deposits on said plugs.

2. A method according to claim 1, wherein the step of detecting comprises ascertaining whether an attempt to start the engine has failed; and the step of generating the state-of-engine signal is performed only after a failed attempt to start the engine; whereby a close succession of sparks is produced across the spark plugs in response to said state-of-engine signal for burning off deposits on the plugs prior to making a further attempt to start the engine.

3. A method according to claim 2, wherein the step of producing said sparks occurs immediately after activation of an engine starting motor has ceased and when, at the same time, the ignition system has a voltage applied thereto.

4. A method according to claim 3, wherein the step of producing said sparks comprises producing said sparks simultaneously to all spark plugs in parallel.

5. A method according to claim 3, wherein the step of producing said sparks comprises producing said sparks in close succession cylinderwise.

6. A method according to claim 5 in which the ignition system is a capacitive type system, wherein the sparks are produced at a frequency of at least 200 Hz.

7. A method according to claim 3 in which the engine starting motor can be activated and the ignition system can be supplied with voltage by means of a manually actuable ignition lock, wherein said step of producing said sparks comprises producing the sparks when an ignition lock is moved from a start position to an ignition position and the ignition lock is thereafter held in the ignition position.

8. An arrangement for improving the starting ability of an internal combustion engine after an unsuccessful attempt to start the engine, said arrangement including an ignition system with ignition devices in each cylinder and further including an electronic control unit which is capable of initiating a spark discharge on the ignition devices in response to at least one sensor intended for sensing an engine parameter, wherein:

the ignition system also includes a detecting means connected to the sensor and operative to detect whether the engine has started or not when an attempt to start the engine is made;

the detecting means is connected to the control unit; and the control unit is constructed to initiate the generation of a close succession of spark discharges in the ignition devices when the detection means indicates that the engine has not started.

* * * * *